US006619425B2

(12) United States Patent
Miyakawa et al.

(10) Patent No.: US 6,619,425 B2
(45) Date of Patent: Sep. 16, 2003

(54) SOUNDPROOF COVER

(75) Inventors: Shinji Miyakawa, Ichinomiya (JP); Satoshi Uematsu, Toyota (JP)

(73) Assignees: Tokai Rubber Industries, Ltd., Komaki (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/176,610

(22) Filed: Jun. 24, 2002

(65) Prior Publication Data

US 2003/0010566 A1 Jan. 16, 2003

(30) Foreign Application Priority Data

Jul. 11, 2001 (JP) ..... 2001-211207

(51) Int. Cl.[7] ..... F01W 1/06
(52) U.S. Cl. ..... 181/204; 181/204; 181/175
(58) Field of Search ..... 181/175–210, 181/284–296; 428/332, 522, 430, 300.7; 156/325–330

(56) References Cited

U.S. PATENT DOCUMENTS 4,447,493 A * 5/1984 Driscoll et al. ..... 428/332
4,851,271 A * 7/1989 Moore et al. ..... 428/34.5

FOREIGN PATENT DOCUMENTS

| | | | |
|---|---|---|---|
| JP | 9-134179 | 5/1997 | |
| JP | 09134179 A * | 5/1997 | ..... G10K/11/16 |
| JP | 10-205352 | 8/1998 | |
| JP | 11-200836 | 7/1999 | |
| JP | 11-324707 | 11/1999 | |

* cited by examiner

*Primary Examiner*—Robert E. Nappi
*Assistant Examiner*—Renata McCloud
(74) *Attorney, Agent, or Firm*—Oblon, Spviak, McClelland, Maier & Neustadt, P.C.

(57) ABSTRACT

A soundproof cover includes a sealing layer, a sound insulation layer, and a vibration inhibition layer. The sound insulation layer has a peripheral portion, is to be disposed so as to contact at least the peripheral portion with a noise source, and exhibits elasticity. The sound insulation layer is formed as a hard plate shape, has an installation portion to be fastened to the noise source, and is disposed so as to cover the sealing layer. The vibration inhibition layer is disposed on at least a part of an interface between the sealing layer and the sound insulation layer so as to adhere to the sound insulation layer, and inhibits the sound insulation layer from vibrating.

12 Claims, 2 Drawing Sheets

SOUNDPROOF COVER

BACKGROUND OF THE INVENTION

1. Field of the Invention

The present invention relates to a soundproof cover which is disposed to a noise source, such as an intake manifold of an automobile, and which can inhibit noises by insulating sounds being generated by the noise source.

2. Description of the Related Art

Automobiles comprise many vibrating component members in which engines are principal one of such component members. To reduce the noises, which are generated by their vibrations, is one of the assignments to automobile engineers. Hence, it has been carried out disposing soundproof covers, which cover the noise sources. For example, in Japanese Unexamined Patent Publication (KOKAI) No. 10-205,352, there is disclosed a soundproof cover, which is constituted by a hard sound insulation layer and a sound absorption layer. The hard sound insulation layer is formed of a resin or steel plate. The sound absorption layer is laminated on one of opposite surfaces of the sound insulation layer which faces a noise source, and is formed of a polymer foamed substance. In this soundproof cover, the sound insulation layer insulates the sounds, which come from the noise source, and the sound absorption layer absorbs the sounds, which come from the noise source.

Namely, the sound waves, which are generated by the noise source, are absorbed by the sound absorption layer to a certain extent when they pass through the sound absorption layer. The rest of the sound waves, which are not absorbed, arrive at the sound insulation layer. Since it is difficult for the sound waves to pass through the hard sound insulation layer, the sound waves are reflected at the sound insulation layer and pass through the sound absorption layer again. Therefore, the sound waves are reflected repeatedly between the noise source and the sound insulation layer so that they are absorbed every time they pass through the sound absorption layer. Accordingly, it is possible to effectively carry out soundproofing.

Moreover, in Japanese Unexamined Patent Publication (KOKAI) No. 9-134,179, there is disclosed another soundproof cover. In this soundproof cover, a sound absorption layer is formed so as to conform to a superficial configuration of a noise source. Moreover, the sound absorption layer is disposed so as to adhere to the noise source. When the sound absorption layer is thus adhered to the noise source, no clearance arises between the soundproof cover and the noise source. Consequently, it is possible to inhibit the noises from leaking through such a clearance.

However, since the sound insulation layer is usually formed as a hard plate shape, there is a drawback in that the sound insulation layer itself makes a noise source when it vibrates. Hence, it has been carried out thickening the sound absorption layer so as to inhibit the sound waves from reaching the sound insulation layer and vibrating the sound insulation layer. Moreover, it has also been carried out fastening the sound insulation layer to the noise source by way of a vibration insulation component member, such as a rubber mount, a grommet, etc., so as to make the sound insulation layer less likely to vibrate.

Yet, in the conventional soundproof covers, it has been difficult to securely inhibit the sound insulation layers from vibrating so that the sound insulation layers themselves do not make a noise source in a case where the noise source vibrates considerably. Moreover, when the conventional soundproof covers are fastened to the noise source by way of a vibration insulation component member, such as a rubber mount, a grommet, etc., the number of the component parts increases by the number of the vibration insulation component members and simultaneously the man-hour requirement for the assembly enlarges. Accordingly, there arises a problem in that the manufacturing cost goes up.

In addition, in a case where the conventional soundproof covers are fastened by way of a vibration insulation component member, it has been required to provide a space which occupies by the height of the vibration insulation component member or more. Consequently, there arises a problem in that the assembly workability is impaired.

SUMMARY OF THE INVENTION

The present invention has been developed in view of such circumstances. It is therefore an object of the present invention to provide a soundproof cover which can be manufactured at a reduced cost and can get rid of the extra space being required in the assembly, and simultaneously which can inhibit a sound insulation layer itself from making a noise source.

A soundproof cover according to the present invention can solve the aforementioned problems, and comprises: a sealing layer having a peripheral portion, to be disposed so as to contact at least the peripheral portion with a noise source, and exhibiting elasticity; a sound insulation layer being formed as a hard plate shape, having an installation portion to be fastened to the noise source, and being disposed so as to cover the sealing layer; and a vibration inhibition layer disposed on at least a part of an interface between the sealing layer and the sound insulation layer so as to adhere to the sound insulation layer, and inhibiting the sound insulation layer from vibrating.

It is preferred that the sealing layer can be formed of polyurethane foam and can have a bonding portion, at which the sealing layer and the sound insulation layer are bonded, at an outer peripheral end thereof.

The sealing layer can desirably exhibit such a characteristic that a compression hardness falls in a range of from 100 to 1,000 N/314 $cm^2$ (i.e., from $3.185\times10^3$ to $3.185\times10^4$ $N/m^2$ approximately). Moreover, the vibration inhibition layer can desirably exhibit such characteristics that a static shear elastic modulus falls in a range of from 4 to 20 $kgf/cm^2$ (i.e., from $3.923\times10^5$ to $1.961\times10^6$ $N/m^2$ approximately) and a loss factor falls in a range of 0.03 or more.

Namely, in accordance with the present soundproof cover, it is possible not only to obviate a rubber mount, a grommet, etc., but also to inhibit the sound insulation layer itself from making a noise source. Therefore, it is possible to sharply reduce the number of component parts in the assembly as well as the man-hour requirement therefor. Thus, it is possible to manufacture the present soundproof cover at a less expensive cost.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Figure 1:
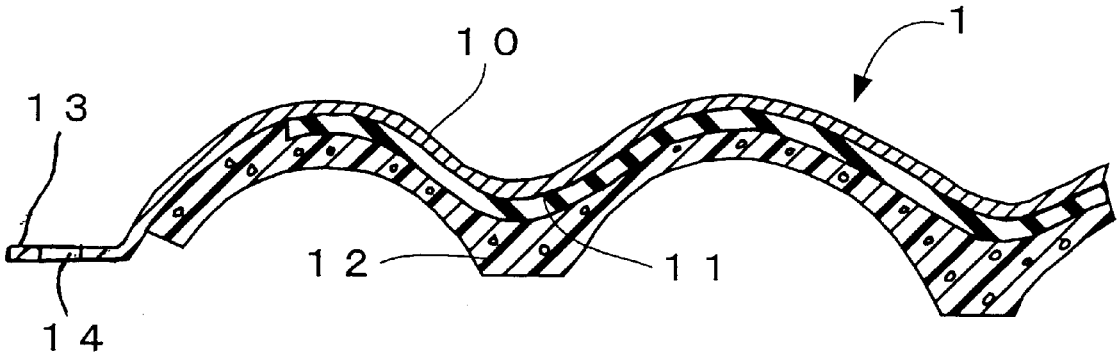
FIG. 1 is a major cross sectional view for illustrating a soundproof cover of an example according to the present invention.

Having generally described the present invention, a further understanding can be obtained by reference to the specific preferred embodiments which are provided herein for the purpose of illustration only and not intended to limit the scope of the appended claims.

In the soundproof cover according to the present invention, the sealing layer is disposed so that at least the peripheral portion contacts with the noise source. Namely, since the sealing layer contacts with the noise source at the entire periphery at least, the leakage of the noises does not occur. Further, since the surface of the sealing layer is covered with the hard sound insulation layer, the noises, which come from the noise source, are insulated by the sound insulation layer. Furthermore, the vibration inhibition layer is disposed so as to adhere to the sound insulation layer. Therefore, even if the sound insulation layer tries to vibrate by the vibrations of the noise source, the vibration inhibition layer inhibits the sound insulation layer from vibrating. Accordingly, the sound insulation itself is inhibited from making a noise source. Due to the synergetic effect of these operations, the present soundproof cover exhibits a high soundproof effect.

The sealing layer can have such a sealing function that it inhibits the sound waves from escaping to the outside. The sealing layer can be formed of a variety of elastic substances. However, the sealing layer can desirably be formed of a polymer foamed substance or a porous substance. The polymer foamed substance can be foamed rubber, foamed polyurethane, polyethylene foam, polypropylene foam, and the like. The porous substance can be non-woven fabric, and so on. When the sealing layer is formed of such a polymer foamed substance or a porous substance, it is possible to have the sealing layer function as a sound absorbing layer. Consequently, the soundproof effect is furthermore upgraded. Moreover, it is sufficient so that the sealing layer contacts with the noise source at the peripheral portion at least. However, it is particularly desirable to dispose the sealing layer so that its entire surface can contact with the noise source.

In addition, the sealing layer can desirably have such a characteristic that a compression hardness falls in a range of from 10 to 1,000 N/314 $cm^2$. This compression hardness is defined in Japanese Industrial Standard (hereinafter abbreviated to as "JIS") K6401. When the compression hardness is adapted to fall in the range of from 100 to 1,000 N/314 $cm^2$, the sealing layer exhibits proper compressibility. Therefore, it is possible to readily dispose the sealing layer so as to conform to the surface of the noise source by the compression deformation. Accordingly, it is possible to furthermore inhibit the clearance from arising between the sealing layer and the noise source. When the compression hardness is less than 100 N/314 $cm^2$, the sound waves are likely to pass through the sealing layer so that there might arise a drawback in that the sounds leak out in a case where the sealing layer is formed of foamed polyurethane. On the other hand, when the compression hardness exceeds 1,000 N/314 $cm^2$, the resulting sealing layer might lack the proper compressibility so that it is less likely to deform. Consequently, it might be difficult for such a sealing layer to absorb the fluctuations in the dimensions and the fluctuations in the positions during the assembly operation. Thus, the clearance is likely to arise between the sealing layer and the noise source.

The sealing layer can desirably have a thickness of 3 mm or more. When the thickness of the sealing layer is thinner than 3 mm, there might be a case where the clearance arises between the resultant sealing layer and the noise source due to the lack of compression. The upper limit of the thickness is not limited in particular. However, it is usually sufficient that the thickness can be such that it falls in a range of from 3 to 30 mm.

As for the sound insulation layer which is laminated so as to cover the sealing layer, it is possible to use a hard plate-shaped member which is made of a resinous plate or a metallic plate. It is necessary that the sound insulation layer can have a mass with respect to its unit surface area as large as to a certain extent. On the other hand, since the shape of the sound insulation layer is determined by the configurations of the noise sources and the contours of the boarding spaces, it is not limited in particular.

The sound insulation layer has the installation portion which is to be fastened to the noise source. Hence, it is possible to fasten the vibration inhibition layer by fastening the hard sound insulation layer to the noise source. In addition, since the sound insulation layer compresses the sealing layer, it is possible to fasten the present soundproof cover in a state that no clearance arises between the noise source and the sealing layer. As far as the sound insulation layer can be directly fastened to the noise source, the installation portion is not limited in particular to means, such as a shape which can mechanically engage with the noise sources, a bolt hole, and the like. In the present soundproof cover, even when the sound insulation layer is fastened directly to the noise sources in such a manner, it is possible to effectively inhibit the sound insulation layer from vibrating because the vibration inhibition layer exists.

It is desired that that the sound insulation layer is bonded with the sealing layer. When the sound insulation layer is not bonded with the sealing layer, there may be a case where the clearance arises between the sound insulation layer and the sealing layer by degradation, and so on, so that the sounds leak through the clearance, or there may be a case where the sound waves intrude the clearance so that the sound insulation layer vibrates to generate secondary radiation sounds. In view of these, it is desired that the present soundproof cover can have a bonding portion, at which the sealing layer and the sound insulation layer are bonded, at an outer peripheral end thereof. When the present soundproof cover has such a bonding portion at the outer peripheral end, at which the sealing layer and the sound insulation layer are bonded, it is possible to hold the vibration inhibition layer between the sealing layer and the sound insulation layer. Accordingly, it is not required to enlarge the bonding strength between the sound insulation layer and the vibration inhibition layer or the bonding strength between the vibration inhibition layer and the sealing layer too much. Alternatively, in certain cases, it is possible to get rid of bonding these constituent members. Thus, it is possible to obviate the pre-adhesion treatments, such as shot blasting, and so on. Therefore, it is possible to make the present soundproof cover less expensive by the reduction of the man-hour requirements.

When the sealing layer is bonded with the sound insulation layer, it is possible to adhere or weld the sealing layer, which has been formed as a predetermined shape in advance, to the sound insulation layer. However, it is preferable to dispose the sound insulation layer in a mold and then to form the sealing layer integrally therewith in the mold. If such is the case, it is desirable to use urethane of good adhesiveness and to form the sealing layer out of polyurethane foam.

The vibration inhibition layer is a constituent member which has a function of inhibiting the sound insulation layer from vibrating. It is possible to form the vibration inhibition layer out of rubber, an asphalt sheet, and the like. The vibration inhibition layer can be formed on a part of the sound insulation layer, or can be formed on the entire surface of the sound insulation layer. In the former case, the sealing layer is formed mostly on the surface of the sound insulation layer, and is formed partially on the surface of the vibration insulation layer. In the latter case, the sealing layer is formed on the surface of the vibration inhibition layer.

The vibration inhibition layer can desirably exhibit a static shear elastic modulus which falls in a range of from 4 to 20 kgf/cm$^2$. This static shear elastic modulus is defined in JIS K6254. When it is adapted to fall in the range of from 4 to 20 kgf/cm$^2$, it is possible to secure a favorable vibration inhibition ability for the present soundproof cover. When the value is lower than 4 kgf/cm$^2$, the resulting vibration inhibition layer might lack a proper vibration inhibition ability. When the value is more than 20 kgf/cm$^2$, there might arise a case where it is difficult to form the vibration inhibition layer out of rubber because the flowablility of rubber degrades.

Moreover, the vibration inhibition layer can desirably exhibit a loss factor which falls in a range of 0.03 or more. This loss factor is defined in JIS K6385. When it is adapted to be 0.03 or more, it is possible to secure a favorable vibration inhibition ability for the present soundproof cover. When the value is less than 0.03, the resulting vibration inhibition layer might lack a proper vibration inhibition ability so that the sound insulation layer itself might make a noise source.

When the vibration inhibition layer is arranged so that it is exposed greatly out of the outer peripheral end of the present soundproof cover, it is necessary to inhibit the vibration inhibition layer from falling down. Moreover, since it is required that the vibration inhibition layer adheres to the sound insulation layer, it is desirable to bond the vibration inhibition layer with the sound insulation layer. For instance, when the vibration inhibition layer is formed of rubber, it is possible to bond the vibration inhibition layer with the sound insulation layer by vulcanization adhesion in the molding of the vibration inhibition layer. In addition, when the vibration inhibition layer is formed of an asphalt sheet, it is possible to bond the vibration inhibition layer with the sound insulation layer by thermal press forming.

When the vibration inhibition layer is arranged so that it is exposed greatly out of the outer peripheral end of the present soundproof cover, there might arise a case where the clearance, which arises between the vibration inhibition layer and the sealing layer, results in the cause of the sound leakage. Therefore, it is desired that the vibration inhibition layer can adhere to the sealing layer as well. For example, when the vibration inhibition layer is formed of rubber and when the sealing layer is formed of foamed polyurethane, it is desirable to form the vibration inhibition layer in advance, and thereafter to roughen the surface of the vibration inhibition layer by shot blasting, and the like, and then to form the sealing layer by carrying out urethane expansion molding. Thus, it is possible to firmly bond the vibration inhibition layer with the sealing layer. As a result, it is possible to inhibit the clearance from arising between the vibration inhibition layer and the sealing layer.

However, when the present soundproof cover is arranged so as to have a bonding portion, at which the sealing layer and the sound insulation layer are bonded, at an outer peripheral end thereof, it is not required, as set forth above, to enlarge the bonding strength between the sound insulation layer and the vibration inhibition layer or the bonding strength between the vibration inhibition layer and the sealing layer too much. Alternatively, in certain cases, it is possible to get rid of bonding these constituent members. Therefore, such an arrangement is especially preferable because it is possible to make the present soundproof cover at a reduced manufacturing cost.

The vibration inhibition layer can preferably have a thickness of 2 mm or more. When the thickness of the vibration inhibition layer is thinner than 2 mm, the vibration inhibition ability of the resulting vibration inhibition layer might lower. The upper limit of the thickness is not limited in particular. However, it is usually sufficient that the thickness can be such that it falls in a range of from 2 to 10 mm.

EXAMPLE

The present invention will be hereinafter described in detail with reference to an example and a testing sample.

Figure 2:
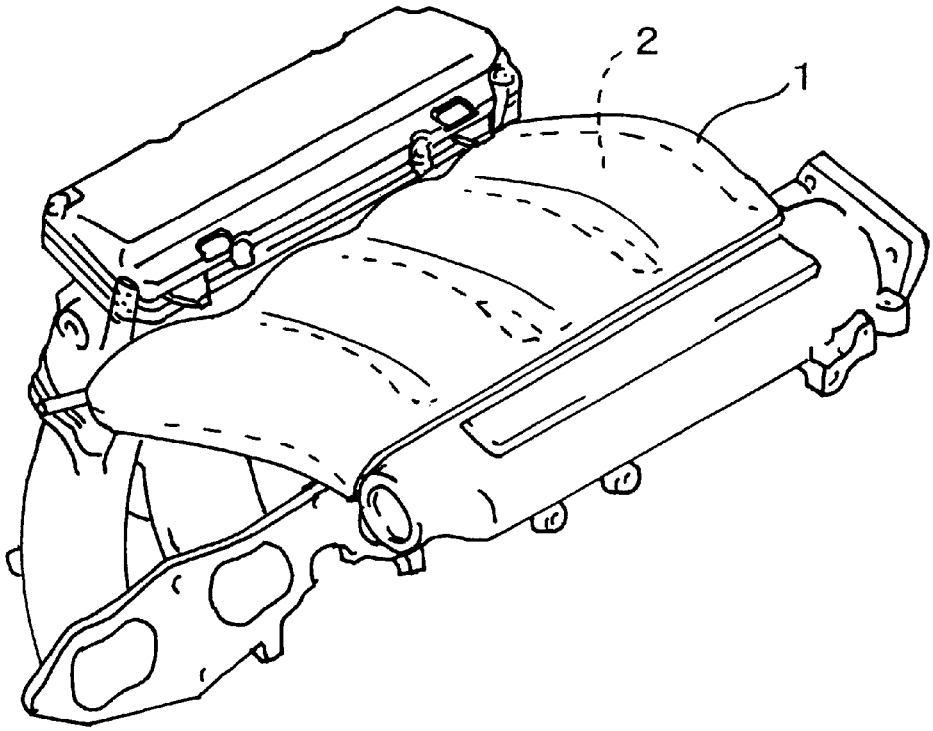
FIG. 2 is an explanatory perspective view for illustrating the soundproof cover of the example according to the present invention in service.
Figure 3:
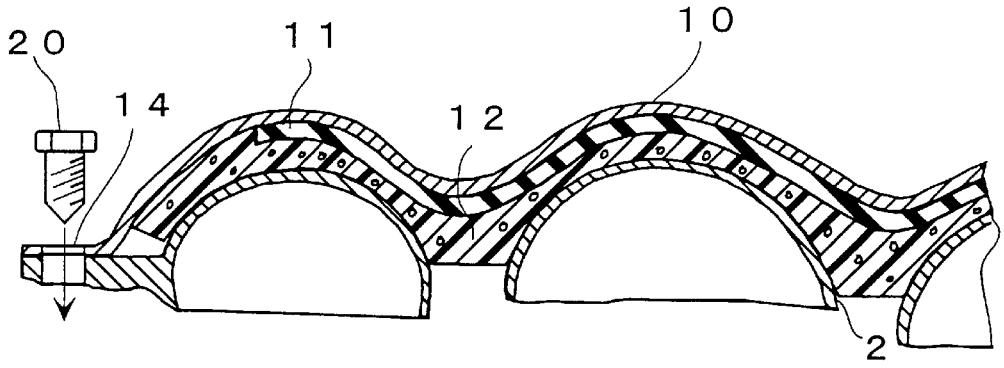
FIG. 3 is a major cross sectional view of FIG. 2.

FIG. 1 illustrates a cross sectional view of a soundproof cover according to an example. FIG. 2 illustrates a perspective view of the soundproof cover in service. FIG. 3 illustrates a major cross sectional view of FIG. 3. The soundproof cover is fastened to an automotive intake manifold to use.

As illustrated in FIG. 1, the soundproof cover 1 comprises a sound insulation layer 10, a vibration inhibition layer 11 and a sealing layer 12. The sound insulation layer 10 is made of a coated steel plate. The vibration inhibition layer 11 is laminated on one of opposite surfaces of the sound insulation layer 10, and is made of rubber. The sealing layer 12 is laminated on the opposite surface of the sound insulation layer 10 as well as on one of opposite surfaces of the vibration inhibition layer 11, and is made of foamed polyurethane.

A manufacturing process for the soundproof cover 1 will be hereinafter described in place of the detailed description on its arrangements.

First of all, a steel plate was punched out, and was thereafter pressed, thereby manufacturing the sound insulation layer 10 having a predetermined shape. The sound insulation layer 10 had a plurality of flanges 13 on its outer periphery. In the respective flanges 13, a bolt hole 14 was drilled through.

Subsequently, the sound insulation layer 10 was placed at a predetermined position in a mold for forming rubber. The vibration inhibition layer 11 was formed in an average thickness of 4 mm by using natural rubber. Excepting the outer peripheral portion of the sound insulation layer 10, the vibration inhibition layer 11 was formed on the entire surface of the sound insulation layer 10 substantially. The vibration inhibition layer 11 was bonded integrally with the sound insulation layer 10 by vulcanization adhesion. Note that the vibration inhibition layer 11 exhibited such characteristics that the static shear elastic modulus, which is defined in JIS K6254, was 7 kgf/cm$^2$ (i.e., $6.865\times10^5$ N/m$^2$ approximately) and the loss factor, which is defined in JIS K6385, was 0.05.

Then, the sound insulation layer 10 with the vibration inhibition layer 11 formed was placed in a mold for expansion forming. Raw materials (i.e., a diisocyanate compound and a polyether-based polymer polyol, amine or water) for foamed polyurethane resin were charged into the mold to carry out expansion molding, thereby forming the sealing layer 12. The sealing layer 12 was bonded integrally with the sound insulation layer 10 at its outer peripheral end (or peripheral portion), and was bonded integrally with the vibration inhibition layer 11 at the rest of the portions. The sealing layer 12 was formed so as to have a shape which conformed to the superficial shape of an intake manifold 2, and had such a characteristic that the compression hardness, which is defined in JIS K6400, was 250 N/314 $cm^2$ (i.e., $7.962\times10^3$ $N/m^2$ approximately).

The thus manufactured soundproof cover 1 was disposed on the intake manifold 2 as illustrated in FIG. 2, and was fastened to the intake manifold 2 with bolts 20 (shown in FIG. 3) by way of the bolt holes 14 to use. In the fastened state, as illustrated in FIG. 3, the sealing layer 12 contacted with the surfaces of the intake manifold 2. Thus, no clearance was formed between the sealing layer 12 and the surfaces of the intake manifold 2. Moreover, even if such a clearance arose between the sealing layer 12 and the intake manifold 2, it was possible to readily fill the clearance by the compressive deformation, which resulted from the fastening of the sound insulation layer 10 with the bolts 20, because the sealing layer 12 was of rich compressibility.

Further, since the vibration inhibition layer 11 exhibited the above-described characteristic values, it inhibited the sound insulation layer 10 from vibrating very well. Therefore, by the soundproof cover 1 according to the example, since the sealing layer 12 functioned as a sound absorbing layer as well, not only the sound absorbing operation, exhibited by the sealing layer 12, but also the sound insulation operation, exhibited by the sound insulation layer 10, were effected. Furthermore, even if the sound insulation layer 10 was fastened directly to the intake manifold 2 so that the vibrations of the intake manifold 2 tried to transmit to the sound insulation layer 10, the sound insulation layer 10 was inhibited from vibrating by a vibration inhibition operation, exhibited by the vibration inhibition layer 11. Thus, the sound insulation layer 10 itself was inhibited from making a noise source. Moreover, since the clearance was inhibited from arising between the sealing layer 12 and the intake manifold 2, there was no drawback in that the noises leaked out through such a clearance.

In addition, the vibration inhibition layer 11 was formed in a thin thickness, and was covered with the sealing layer 12. Accordingly, the soundproof cover 1 according to the example had a thickness, which was equivalent to that of the conventional soundproof cover including a sound insulation layer and a sound absorbing layer only, as a whole. Still further, the soundproof cover 1 obviated the vibration inhibition component parts, such as rubber mounts, grommets, etc., which had been required to assemble the conventional soundproof covers, and could be accordingly assembled without them. Consequently, the number of the component parts was reduced, and the operation space required for the assembly could be diminished. Thus, it was possible to sharply reduce the man-hour requirement.

Testing Sample

Figure 4:
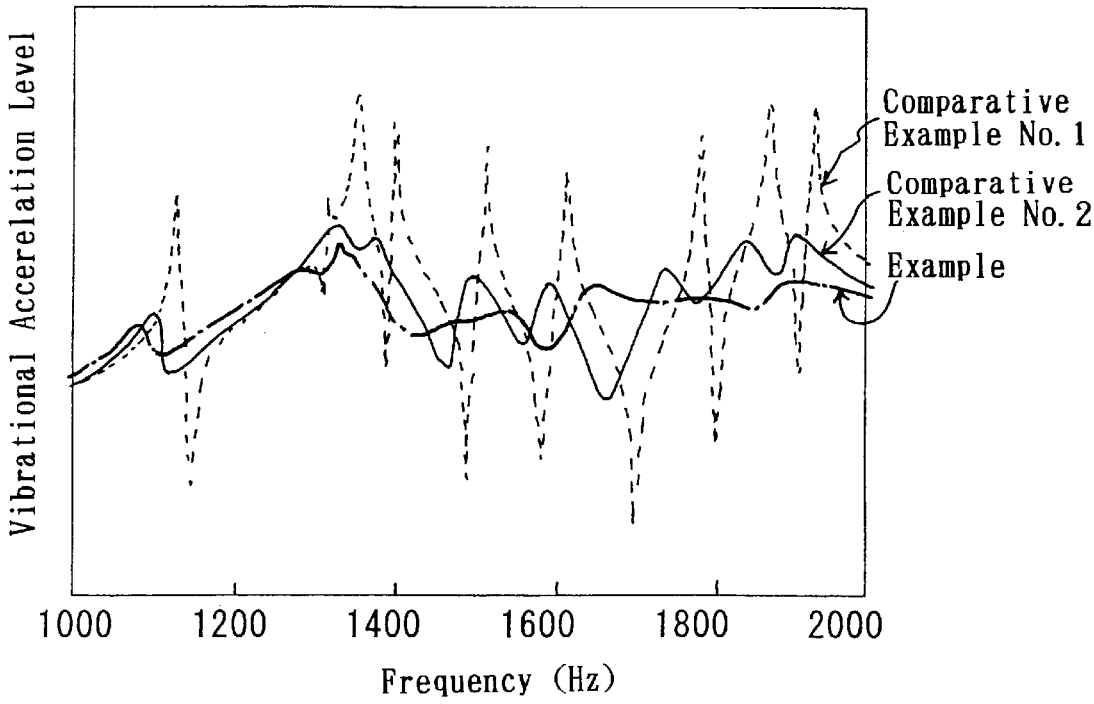
FIG. 4 is a graph for illustrating the relationships between the frequencies and the vibrational acceleration levels which were exhibited by the example and comparative examples.

The sound insulation layer 10 of the soundproof cover 1 according to the above-described example was hit by a hammer with a predetermined force. The hammer was produced by Leon Co., Ltd., and was a type, "PH-51." In this instance, the vibrations of the insulation layer 10 were detected by a pickup, were amplified by a charge amplifier, and were thereafter measured for the g force "G" and vibration force in the surface of the sound insulation layer 10 as well as for the respective frequencies by an analyzer. The pickup was produced by Endebco Co., Ltd., and a type, "226C." The charge amplifier was produced by B&K Co., Ltd., and had a trade name, "NEXUS." The analyzer was produced by LMS Co., Ltd., and had a trade name, "Cada-X." At the respective frequencies, the quotients, which were obtained by dividing the respective g forces "G" in the surface of the sound insulation layer 10 with the respective vibration forces therein, were calculated as the vibrational accelerations. FIG. 4 illustrates the results.

Note that, for comparison, the measurements were carried out similarly on a case (Comparative Example No. 1) where a soundproof cover was provided with the sound insulation layer 10 only as well as on another case (Comparative Example No. 2) where a soundproof cover had the same arrangements as those of the example except that it was free from the vibration inhibition layer 11. FIG. 4 illustrates the results as well.

The graph of FIG. 4 implies that the smaller the vibrational accelerations have the heights of the peaks, which protrude toward the plus side, the higher the soundproof effect is exhibited. Namely, since the soundproof cover of Comparative Example No. 2 exhibited the heights of the peaks, which protruded toward the plus side, smaller than those exhibited by the soundproof cover of Comparative Example No. 1, it is understood that the soundproof effect was produced to a certain extent by simply forming the sealing layer 12. However, the soundproof cover according to the present example exhibited the heights of the peaks, which protruded toward the plus side, much smaller than those exhibited by the soundproof cover of Comparative Example No. 2. Moreover, note that the difference was noticeable especially on the higher frequency side. Thus, it is evident that the advantage resulted from forming the vibration inhibition layer 11.

Having now fully described the present invention, it will be apparent to one of ordinary skill in the art that many changes and modifications can be made thereto without departing from the spirit or scope of the present invention as set forth herein including the appended claims.

What is claimed is:

1. A soundproof cover, comprising:

a sealing layer having a peripheral portion, to be disposed so as to contact at least the peripheral portion with a noise source, and exhibiting elasticity;

a sound insulation layer being formed as a hard plate, having an installation portion to be fastened to the noise source, and being disposed so as to cover the sealing layer; and a vibration inhibition layer made of solid rubber disposed on at least a part of an interface between the sealing layer and the sound insulation layer so as to adhere to the sound insulation layer, inhibiting the sound insulation layer from vibrating, and exhibiting such characteristics that a static shear elastic modulus falls in a range of from 4 to 20 kgf/cm2 and a loss factor falls in a range of 0.03 or more.

2. The soundproof cover according to claim 1, wherein said sealing layer is formed of polyurethane foam and has a bonding portion, at which said sealing layer and said sound insulation layer are bonded, at an outer peripheral end thereof.

3. The soundproof cover according to claim 1, wherein said sealing layer exhibits such a characteristic that a compression hardness falls in a range of from 100 to 1,000 N/314 $cm^2$.

4. The soundproof cover according to claim 1, wherein said sound insulation layer is fastened directly to the noise source.

5. The soundproof cover according to claim 1, wherein said soundproof cover is disposed on an intake manifold.

6. The soundproof cover according to claim 1, wherein said sealing layer has a thickness of 3 mm or more.

7. The soundproof cover according to claim 1, wherein said sealing layer is formed of urethane foam.

8. The soundproof cover according to claim 1, wherein said sound insulation layer and said sealing layer are bonded.

9. The soundproof cover according to claim 1, wherein said vibration inhibition layer and said sound insulation layer are bonded.

10. The soundproof cover according to claim 1, wherein said vibration inhibition layer has a thickness of 2 mm or more.

11. The soundproof cover according to claim 1, wherein said sealing layer contacts the noise source at its entire surface.

12. The soundproof cover according to claim 1, wherein said vibration inhibition layer is formed on an entire surface of said sound insulation layer except at its peripheral portion.

* * * * *